United States Patent [19]

Grass

[11] Patent Number: 4,862,555

[45] Date of Patent: Sep. 5, 1989

[54] ADJUSTABLE FITTING FOR OVERHEAD OPENING CABINET DOOR

[75] Inventor: Alfred Grass, Hochst/Vlbg., Austria

[73] Assignee: Alfred Grass Ges.m.b.H. Metallwarenfabrik, Hochst/Vlbg., Austria

[21] Appl. No.: 200,447

[22] Filed: May 31, 1988

[30] Foreign Application Priority Data

Jun. 4, 1987 [DE] Fed. Rep. of Germany ..... 3718730

[51] Int. Cl.[4] ..... E05D 5/00; E05F 1/08

[52] U.S. Cl. ..... 16/291; 16/382; 16/DIG. 43

[58] Field of Search ..... 16/238, 240, 241, 245, 16/246, 288, 291, 294, 382, DIG. 43

[56] References Cited

U.S. PATENT DOCUMENTS 4,590,641 5/1986 Lautenschlager et al. ..... 16/291 X

FOREIGN PATENT DOCUMENTS 605637 11/1934 Fed. Rep. of Germany .
3605637 10/1986 Fed. Rep. of Germany .
86/02402 4/1986 World Int. Prop. O. ..... 16/238

*Primary Examiner*—Nicholas P. Godici
*Assistant Examiner*—William S. Andes

[57] ABSTRACT

An adjustable fitting for a cabinet with a door adapted to swing up over the head of the user for adjustable fastening of the door-side end of a swivel arm to the inner side of the door embodies a bearing plate pivotally attached to the door-side end of the swivel arm and a base plate fixedly secured to the inner side of the door. A hook-shaped holding lug formed in the base plate slideably engages a cutout and associated shoulder surface conformed in the bearing plate. Open-ended slots are provided in the bearing plate through which locking screws are inserted into threaded holes of associated raised ears in the upper surface of the base plate opposite the holding lug. The locking screws have collar portions which are larger in diameter than the open ends of the open-ended slots and threaded portions which are smaller in diameter than the open ends of the open-ended slots. The bearing plate has vertical wings extending upwardly from its lateral edges and the vertical wings each have bottom portions with semi-circular openings and adjacent rectangular openings therein for receiving the groove of a bearing sleeve. A spindle attached to the door side end of the swivel arm is inserted into the bearing sleeves. The spindle has a circular groove for engagement by the lug of a slider which is slideably attached to the upper surface of the bearing plate.

4 Claims, 6 Drawing Sheets

ADJUSTABLE FITTING FOR OVERHEAD OPENING CABINET DOOR

The invention relates to an adjustable fitting for a cabinet with a door that can be swung up over the head of the user for adjustable fastening of a swivel arm on the inner side of the door, comprising a bearing plate arranged at the end of the swivel arm and pivoting on a spindle, this plate being braced in an adjustable way on a further plate fixed to the door.

An adjustable fitting of this kind is already known through German Published Patent Application No. DE-OS-36 05 637 A1. According to this application, the swiveling bearing plate at the end of the swivel arm and the other plate fixed to the door are arranged one after the other in one plane on the inner side of the door. The disadvantages here are that assembly of the plates on the door is relatively expensive, requiring precise alignment of the plates with respect to each other, and the adjusting screws, which are at the same time fastening screws, engage the wood of the door, and repeated shifting entails the risk that the bearing plate will work loose. Because of the divided arrangement in one plane of the bearing plate on the swivel arm and of the other plate fixed to the door, a previous positioning had to be loosened again for positioning of a plane of the door, which had the disadvantage that the door already aligned in one plane could shift again.

The object of the present invention is to design an adjustable fitting of the type mentioned above so that, with a simple and quick fitting assembly, the door can be simply and quickly oriented in different planes without an already set direction changing when the door is shifted in another direction, and so that there will be a particularly reliable connection between the swivel arm and the wood area of the door.

This object is achieved in that the invention provides a base plate fixed to the door and an adjustable bearing plate on the swivel arm and covering the base plate.

The principle of the invention is that a base plate is set in a particularly rigid arrangement in the wood area of the door and the adjusting components for the different planes of the door are all provided on a bearing plate that covers the base plate. This simple and reliable assembly of the arrangement achieves a particularly rigid connection between the swivel arm and the door and, in particular, avoids placing adjusting devices in the wood area of the door. The base plate now acts as a fixed reference point since no adjusting devices originating there engage the bearing plate. The bearing plate is braced on the base plate, and a change of positioning once made, possibly with deformation of the bearing plate, will be avoided when the door is positioned in another plane.

An advantage of the base plate is that it has a hook-shaped holding lug that is bent upwards and parallel to the surface of the door and, through a recess of the bearing plate in the area of a cutout, lies against a shoulder surface of the bearing plate. From the outset, this simple assembly arrangement provides a loose connection as an overlapping arrangement between the base plate and the bearing plate that allows later easy adjustment of the door in all planes.

An advantage of the base plate is that it has four laterally opposite holes for fastening screws. This makes it possible for the base plate to be a reference point in a particularly rigid arrangement in the wood area of the door.

In a development of the invention, the base plate has two raised ears with threads opposite the hook-shaped lug to receive locking screws through associated slots of the bearing plate. This makes it possible for the bearing plate, its one side being gripped by the holding lug of the base plate, to be clearly fixed on the other side but still easily adjustable in the slots.

An advantage of the bearing plate is that, opposite the shoulder surface, it has slots open on one end as guide slots in the form of stampings protruding from its surface. In conjunction with the ears of the base plate, this achieves an advantageous guide for the bearing plate on the base plate that still allows adjustment over short distances.

As protection against failure, the bearing plate has slots with narrowing opening areas that have opposing projections, the spacing between them being larger than the thread and smaller than the collar of the locking screws. The advantage of this is that it prevents the bearing plate from detaching itself from the base plate during the adjustment action.

Two lifting screws opposite each other are provided in thread guides in the base of the bearing plate. The advantage of this is that the angle or joint correction of the end face of the door relative to the body of the cabinet is achieved, possibly with deformation of the bearing plate.

Grooves are provided in the area of the locking screws on the top side of the base plate and on the bottom side of the bearing plate. This facilitates alignment of the bearing plate on the base plate so that a locking vertical adjustment of the door can be carried out even under the weight of the door. This avoids undesired displacement of the two plates with respect to each other. After the screws are tightened for non-positive connection, positive gripping of the two plates is also achieved.

The bearing plate has vertical wings projecting at the sides with an arched recess that changes to a narrowed area that is open at the bottom and extends into the area of a rectangular recess. The spindle of the swivel arm is fixed from the bottom to the bearing plate in that bearing sleeves with a circular groove are pressed into the arched recesses of the wings of the bearing plate and the spindle stubs are supported in these bearing sleeves. The bearing plate can thus swivel in a particularly easy and advantageous way on the spindle of the swivel arm.

A circular groove is provided to advantage in the spindle of the swivel arm which is engaged from the base of the bearing plate by a lug of a slider arranged to displace in a slot. This can be used to advantage to adjust and fix the lateral position of the bearing plate and the base plate respectively the lateral position of the door relative to the swivel arm.

The subject matter of the present invention comes not only from the subject matter of the individual patent claims but also from a combination of the individual patent claims with each other. All information and features disclosed herein, particularly the configuration shown in the drawings, are claimed as essential to the invention to the extent that they are new with respect to the prior art, viewed individually or in combination.

The invention is explained in more detail below using only one example embodiment illustrated in the drawings.

Figure 5A:
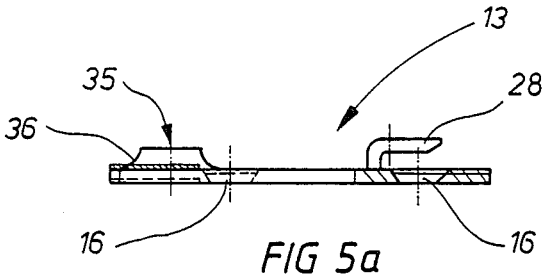
FIG. 5 is a plan view of the base plate.
Figure 5:
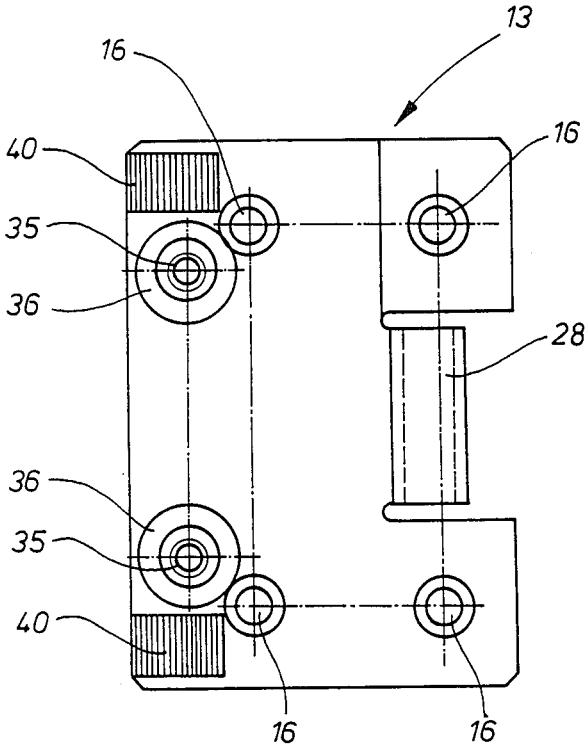

FIG. 5*a* is a side elevation of the base plate in accordance with FIG. 5, partially cut away.

Figure 5B:
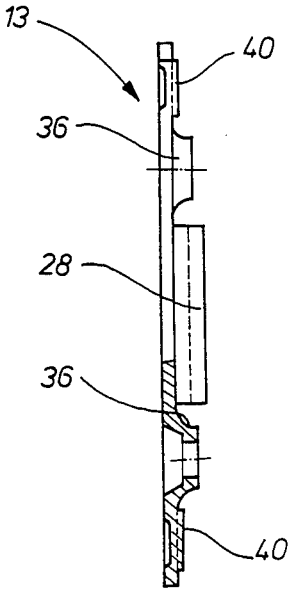

FIG. 5*b* is an end elevation of the base plate in accordance with FIG. 5, partially cut away.

Figure 6A:
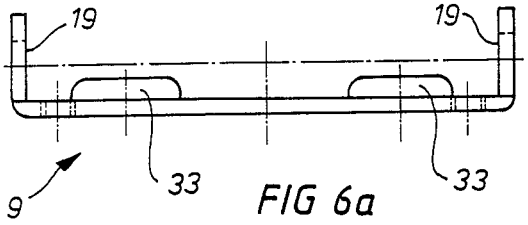
Figure 6B:
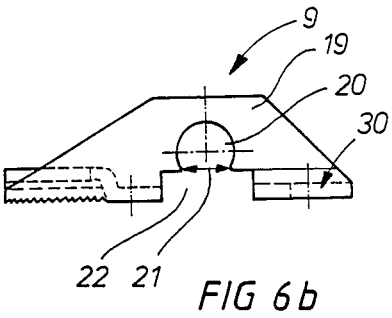
Figure 6:
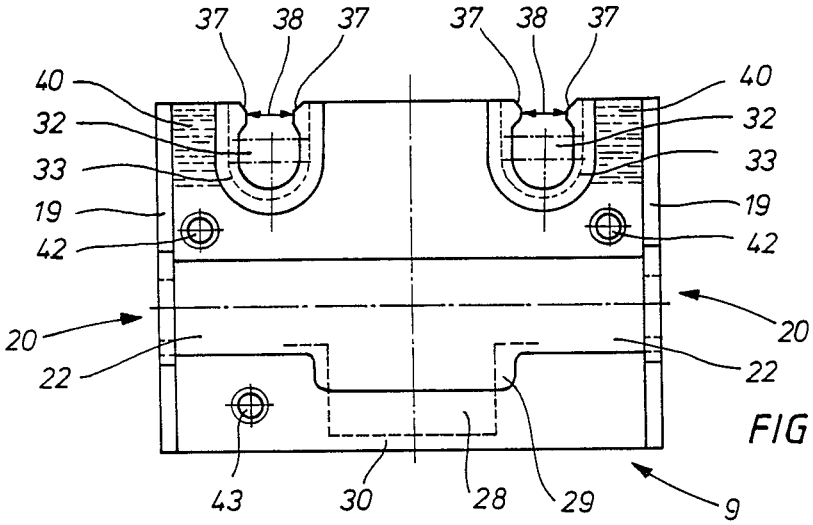

FIG. 6 is a plan view of the bearing plate.

FIG. 6*a* is an end elevation of the bearing plate in accordance with FIG. 6.

FIG. 6*b* is a side elevation of the bearing plate in accordance with FIG. 6.

Figure 7:
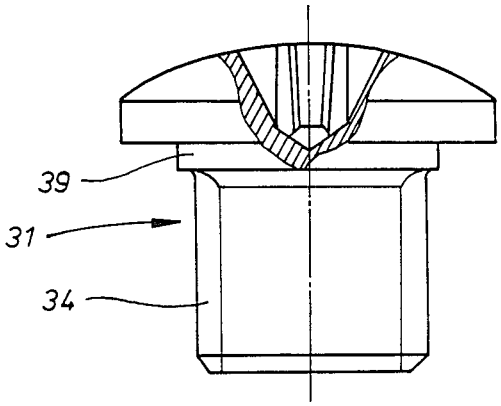

FIG. 7 is a side elevation of a locking screw.

Figures 8, 8A, 8B, 8C:
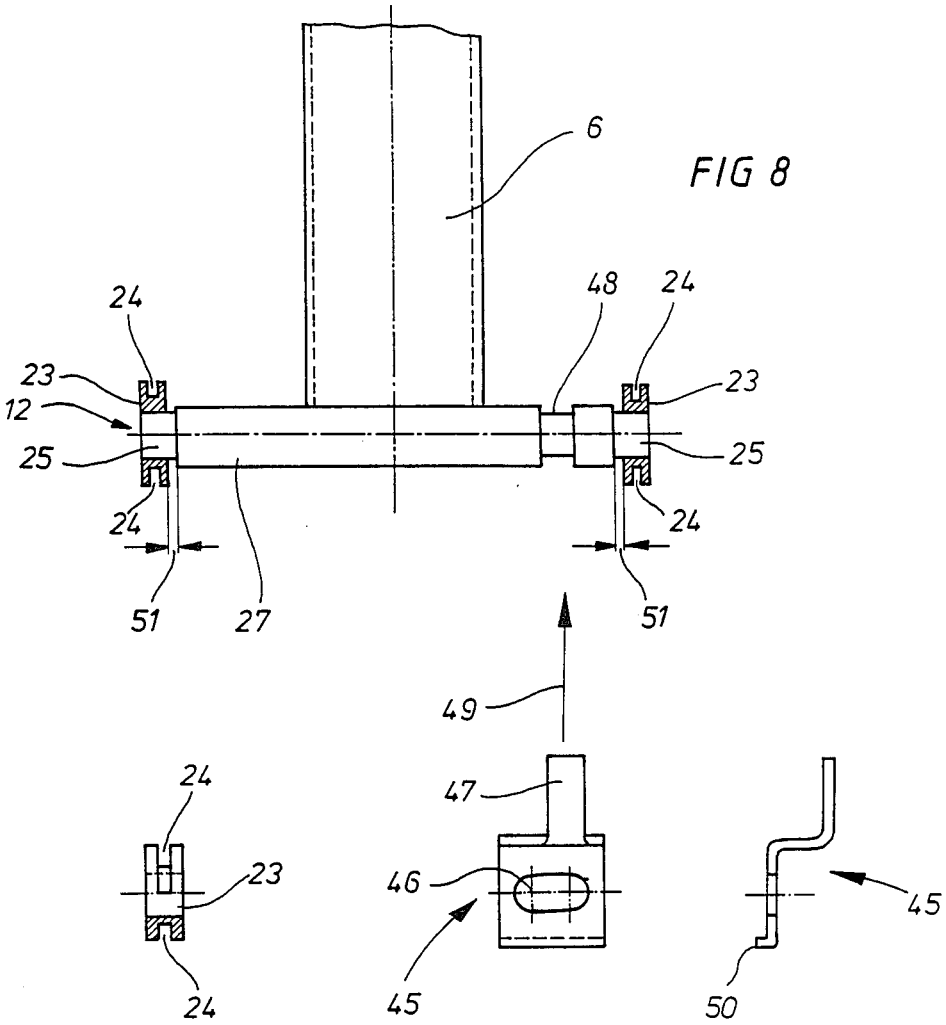

FIG. 8 is a schematic illustration of the bearing of the swivel arm on a horizontal shaft.

FIG. 8*a* is the top view of a slider.

FIG. 8*b* is the side elevation of a slider.

FIG. 8*c* is the illustration of a bearing sleeve.

Figure 9:
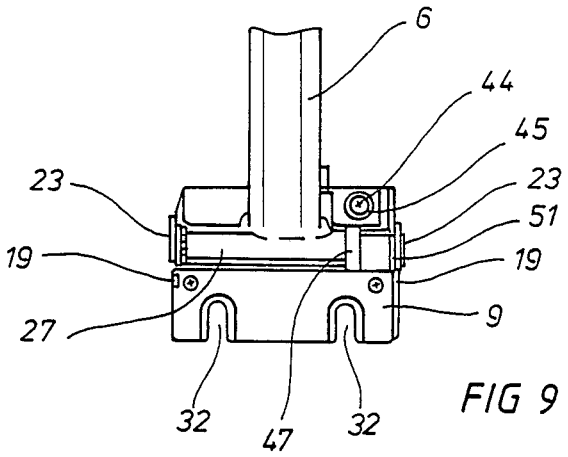

FIG. 9 is a top view of the swivel arm with mounted bearing plate.

Figure 10:
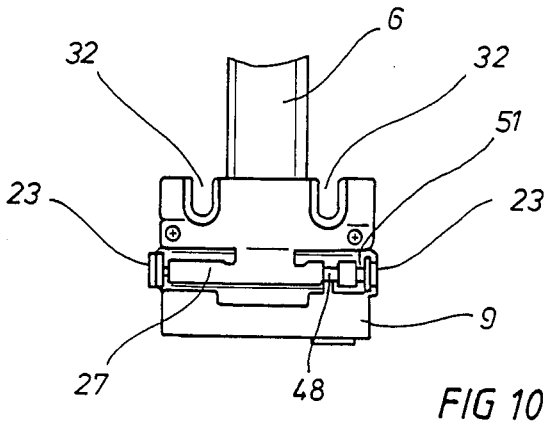

FIG. 10 is the bottom side of the swivel arm in accordance with FIG. 9.

Figure 1:
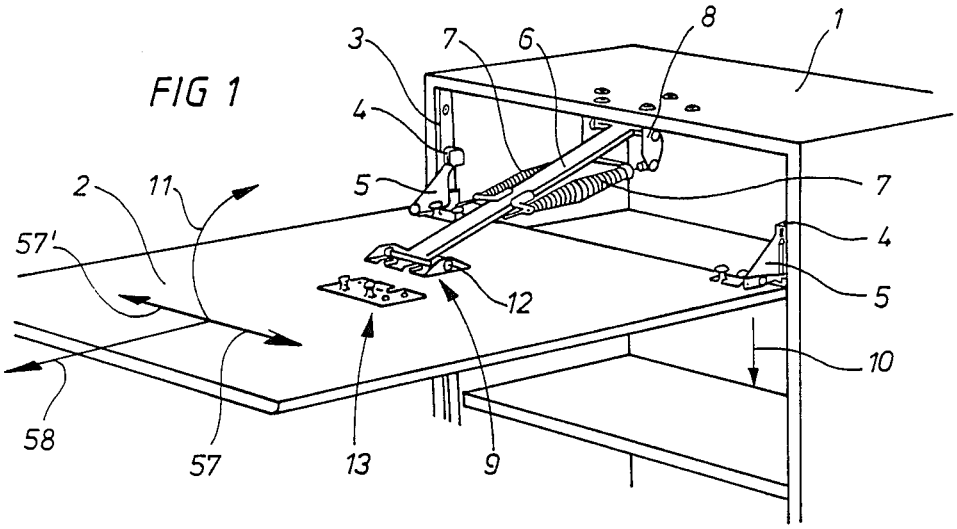
FIG. 1 is a perspective illustration of a cabinet with door that can be swung up with arrangement of the swivel arm with adjustable fitting in accordance with the invention.

FIG. 1 shows a cabinet 1 with a door 2 that can be swung up over the head of the user, the door 2 being in the open position. Arranged on the inside at the sides of the cabinet 1 are vertical rails 3 on which the bottom part of the door 2 is raised or lowered through sliders 4 and guides 5. When the door 2 is closed in the direction of the arrow 10, the free end of the door 2 makes a curving swivel motion in the direction of the arrow 11 over the head of the user.

By means of springs 7 starting at about its middle, the swivel arm 6 is braced against and pivots on a bearing 8 fixed to the cabinet. According to the invention, the other end of the swivel arm 6 is adjustably connected with the door 2.

A bearing plate 9 is arranged to swivel on a spindle 12 on the swivel arm 6, this bearing plate 9 being adjustably mounted on and covering a base plate 13 fixed to the door.

Figure 2:
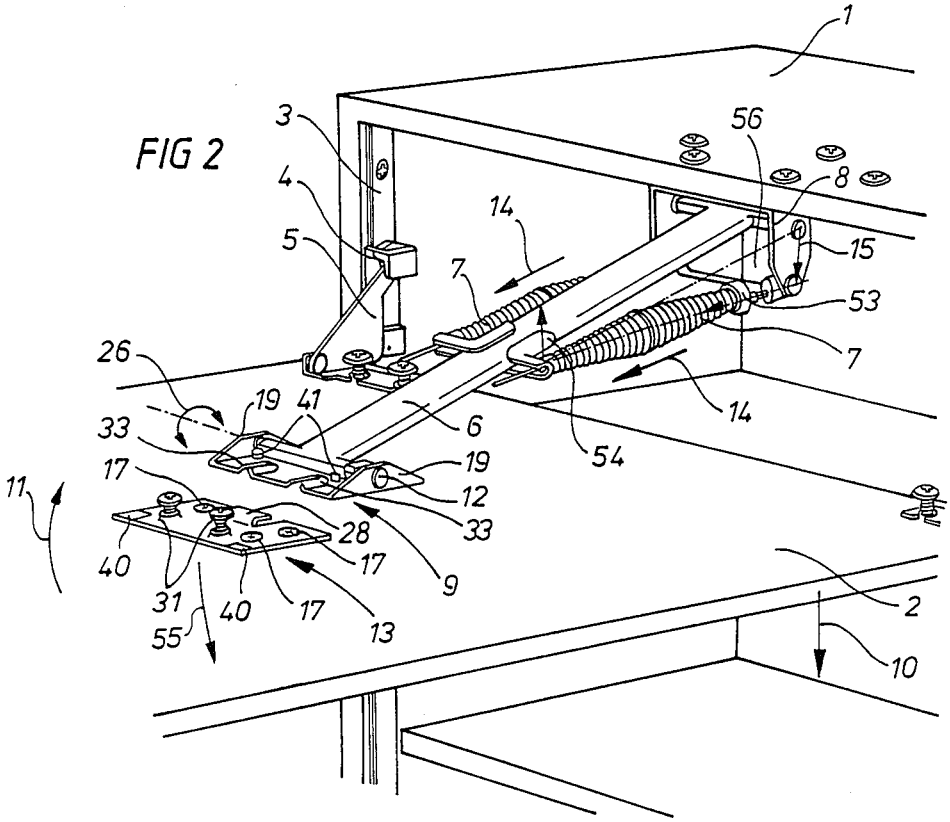
FIG. 2 is an enlarged illustration according to FIG. 1.

It can be seen in FIG. 2 that forces of the springs 7 in the direction of the arrow 14 through a lever arm 15 cause the door to open and, on swivelling beyond a dead center, cause it to close. According to FIG. 2, a triangle of forces 56 is created whereby spring forces 53 act on the lever arm 15 in the direction of the arrow 14 and produce a resultant torque 54 as a resultant balance of weight on the swivel arm 6. This is opposed by an equally high torque formed by the door weight 55. To this extent, the base plate and the bearing plate are loaded only by the weight of the door 2.

According to FIG. 1 and 2 as well as FIG. 4, the base plate 13 is rigidly fixed on the inner side of the door 2 a little below the middle of the door in the longitudinal direction. The base plate 13 has holes 16 for the fastening screws 17. According to FIG. 4, threaded sleeves 18 are driven into the door 2 and are engaged by the thread of the fastening screws 17.

According to FIG. 2, the bearing plate has parallel lateral wings 19 or side plates with arched recesses 20 as shown in FIG. 6*b* that first open downward into a narrowed area 21 and then change into an expanded rectangular area of a recess 22.

Bearing sleeves 23 with their circular grooves 24 are, as shown in FIG. 8 and FIG. 8*c*, pressed into the arched recesses 20 shown in FIG. 6*b*. As shown in FIG. 8, the bearing sleeves 23 receive the spindle stubs 25 of the spindle 12 of the swivel arm 6 so that, according to FIG. 2, the bearing plate 9 on the swivel arm 6 can swivel on the spindle 12 in the direction of the arrow 26 (FIG. 2). The transverse axis of the swivel arm 6 according to FIG. 8 can be designed in one embodiment as a sleeve 27 into which the spindle 12 is driven. The transverse axis is designed to advantage in one piece as a spindle 12 with spindle stubs 25 formed on both sides.

Figure 3:
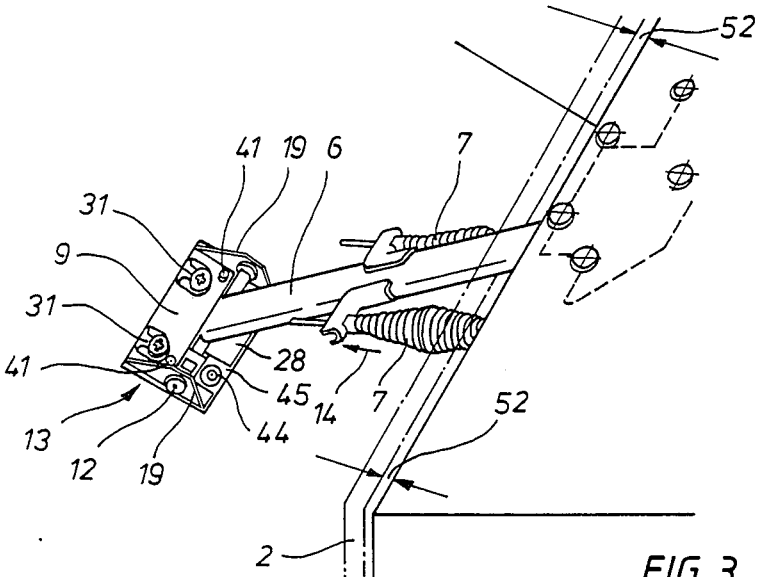
FIG. 3 is a top view of a swivel arm with adjustable fitting to illustrate the joint and angle correction.

The bearing plate 9 at the end of the swivel arm 6 and the base plate 13 on the door 2 are not adjustably interconnected according to the invention as shown in FIG. 3. For this purpose, the base plate has, as shown in FIG. 2, FIG. 4 and FIG. 5 as well as FIG. 5*a* and FIG. 5*b*, a holding lug 28 that when the bearing plate 9 is slid onto the base plate 13 through the recess 22 of the bearing plate 9 in the area of the cutout as shown in FIG. 6, lies on and overlaps a shoulder surface 30 as indicated by the dashed line in FIG. 6. To this extent, the bearing plate is adjustably arranged on the base plate 13 and secure from being lifted away by the hook-shaped holding lug 28.

The bearing plate 9 is then adjustably fixed to the base plate 13 by means of locking screws 31 as shown in FIG. 3. For this purpose, the bearing plate 9 has slots 32 as shown in FIG. 6 that protrude from the surface of the bearing plate 9 in the form of stampings as shown in FIG. 6*a* as guide slots. The threads 34 (as shown in FIG. 7) of the locking screws 31 engage the threaded holes 35 of the base plate 13 through these slots 32. The threaded holes 35 are provided in the base plate in the form of raised ears 36 as shown in FIG. 5, FIG. 5*a* and FIG. 5*b* so that an advantageous guidance of the stampings 33 of the bearing plate 9 can be achieved at the same time there.

As shown in FIG. 6, the slots 32 have narrowings in the form of projections 37 toward the open side as security against failure. The opening area 38 of the slots 32 is larger than the thread 34 of the locking screws 31 as shown in FIG. 7 but smaller than the collar 39 of the locking screws 31. To this extent, the bearing plate 9 can be displaced on the base plate 13 by simply loosening the locking screws 31 without the risk of separation of the bearing plate 9 from the base plate 13. Further unscrewing of the locking screws 31 from the base plate 13 is required before the threads can be drawn out of the opening area 38 and the bearing plate can be completely separated from the base plate or pushed on there.

As shown in FIG. 5 and FIG. 6, grooves 40 are provided at the side in the area of the locking screws 31 and the slots 32 on the top side of the base plate and on the bottom side of the bearing plate 9. This prevents a vertical displacement of the door when the locking screws 31 are unscrewed slightly. Further unscrewing of the locking screws 31 is required before the grooves 40 will separate under the weight of the door 2 so that a locking displacement of the swivel arm 6 within the slots 32 is now possible. Furthermore, following tightening of the screws, an additional form-fitting connection of the two plates is achieved, thus largely preventing shifting particularly in the case of heavy doors or when a door is slammed shut.

The bearing plate 9 is lifted from the base plate 13 through lifting screws 41 as shown in FIG. 3 and which are arranged in threads 42 in the bearing plate 9 as shown in FIG. 6.

The bearing plate 9 is also provided with a thread 43 to receive the fastening screw 44 of a slider 45 as shown in FIG. 9 and FIG. 8*a*. The slider 45 is guided in a slot 46 on the bearing plate 9, a lug 47 of the slider 45 engaging a circular groove 48 in the direction of the arrow 49. As shown in FIG. 8*b*, the slider 45 is angular in shape and has a shoulder 5 which lies against the end face of the bearing plate 9 to prevent twisting.

As shown in FIG. 8, FIG. 9 and FIG. 10, the bearing plate 9 with the base plate 13, that is, the door 2 opposite the swivel arm, can be displaced laterally within a clearance 51 between the wings 19 of the bearing plate 9. The bearing plate 13 with the door 2 and the bearing plate 9 with the wings 19 and the bearing sleeves 23 as shown in FIG. 8 are displaced in the clearance 51 on the spindle stubs 25. The lug 47 of the slider 45 as shown in FIG. 8*a* engages a circular groove 48 of the spindle 12 of the direction of the arrow 49 and, after displacement is carried out, is fixed in the area of the slot 46 by tightening of the fastening screw 44 as shown in FIG. 4. When the door is displaced laterally, the fastening screws of the guide as shown in FIG. 2 may be loosened. The slider 45 is then used to fix the swivel arm 6 relative to the bearing plate 9 or relative to the base plate 13 and the door 2 to which it is fixed in order to set the clearance 50.

FIG. 9 shows the lateral clearance 51 of the door 2 relative to the swivel arm 6, this clearance 51 being fixed by means of the lug 47 of the slider 45 through adjustment of the slider 45 in its slot 46 and through tightening of the fastening screws 44.

FIG. 10 shows the circular groove 48 that is engaged by the top side of the lug 47 as shown in FIG. 9.

When the bearing plate 9 is mounted on the base plate 13, the bottom sides of the bearing sleeves 23 lie to advantage on the base plate as shown in FIG. 10 so that the bearing sleeves 23 will, to this extent, be locked in the recess 22.

The fitting consisting of the bearing plate 9 and the base plate 13 can now be moved in different directions in order to adjust the door 2 in different planes.

For lateral adjustment of the door in directions 57 and 57', that is, for setting the vertical joint between two doors arranged next to each other in the case of adjoining cabinets 1, the base plate 13 with the bearing plate 9 is displaced on the spindle as shown in FIG. 2, FIG. 3 and FIG. 8 in the clearance 51 between the wings 19 and then fixed in the circular groove 48 with the lug 47 of the slider 45 in its slot 46. The lug 47 of the slider 45 engages the circular groove 48 cut in the spindle 12 and, when the slider is shifted in its slot 46, the swivel arm 6 is fixed relative to the door 2 through the sleeve 27, thus achieving a very simple and precise adjustment without changing any prior setting of the door 2 relative to the height or frontal joint.

Figure 4:
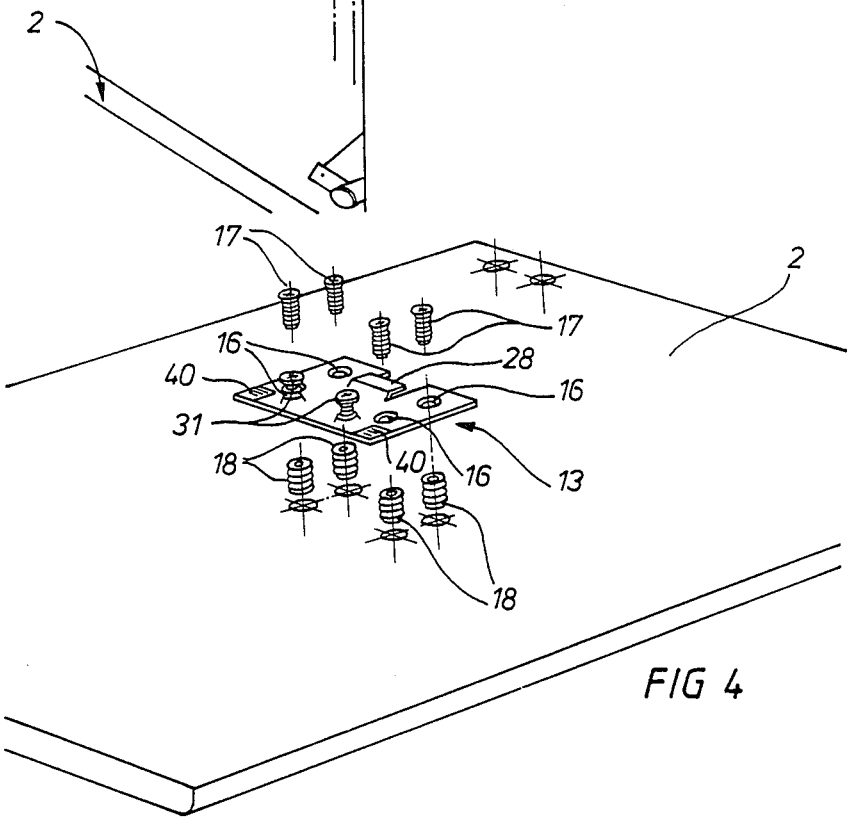
FIG. 4 is a perspective illustration of the base plate with locking screws and fastening screws.

For adjusting the height of the door 2, that is, for adjusting the height of the end faces of the door relative to the end faces of the cabinet 1, the locking screws 31 as shown in FIG. 2 and FIG. 4 are unscrewed enough so that the grooves 40 in the bearing plate 9 and the base plate 13 disengage and the door 2 is vertically aligned in the slots 32 as shown in FIG. 6. This will not change any prior lateral or angular positioning of the door.

For angle correction of the door 2, that is, for correction of the joint 52 as shown in FIG. 3, lifting screws 41 are tightened more or less on the bearing plate 9 so that the bearing plate 9 is braced with possible deformation against the base plate 13 so that the height of the wings 19 can be changed over short distances relative to the base plate 13. The lifting screws 41 press away from the surface of the base plate 13 and distort the bearing plate 9 slightly, which makes it possible to carry out the angular correction of the door 2. The joint 52 between the top edge of the door and the top edge of the cabinet body when the door is closed is changed in width so that a joint with a precisely equal width will be seen on both the left and right sides of the cabinet body. Here, too, there will be no change in any veretical or lateral adjustments already made to the door 2, because no adjustments such as in the wood area are made to the base plate itself that would have to be readjusted later.

The protection against failure as shown in FIG. 6 with projections 7 opposite each other in the opening area of the slots 32 to prevent the swivel arm 6 and the base plate 13 from separating, particularly when there is a shift of the door in the direction 58.

Fixing of the bearing sleeves 23 in the area of the wings 19 in the circular grooves 24 with the narrowed area 21 prevents the spindle 12 from working loose from the wings 19 even with heavy doors, particularly with the bearing plate 9 lifted away from the base plate 13 by the lifting screws 41 for joint adjustment.

This arrangement, particularly the base plate 13, can be mounted easily because no adjusting devices are provided on the base plate 13 itself which would require consideration from the very beginning.

The adjustable fitting is also partiularly stable with respect to the connection to the door 2 because all adjusting devices are associated with the base plate rigidly fixed to the door and no adjusting devices engage the wood area of the door itself.

I claim:

1. Adjustable fitting for a cabinet with a door adapted to swing up over the head of a user for adjustable fastening of a door-side end of a swivel arm to an inner side of the door, comprising: a bearing plate having upper and lower surfaces with the upper surface of the bearing plate pivotally attached to the door-side end of the swivel arm; a base plate having upper and lower surfaces with the lower surface fixedly secured to the inner side of the door; a hook-shaped holding lug formed in said base plate; a cutout and associated shoulder surface formed in the bearing plate to slideably engage and receive said holding lug; two raised ears spaced from each other formed in the base plate upper surface opposite the holding lug, each of the ears having a threaded hole therein; an associated open-ended slot formed in the bearing plate; locking screws extending through the open-ended slots and threadably received by the threaded holes of said raised ears, each of said locking screws having a collar portion of a pre-determined diameter and a threaded portion of a pre-determined diameter, and the open end of said open-ended slots each having an opening larger than the diameter of said threaded portions of the locking screws and smaller than the diameter of said collar portions of said locking screws.

2. Adjustable fitting as described in claim 1, said bearing plate having opposing lateral edges and vertical wings having top and bottom portions extending upwardly from said bearing plate lateral edges, each of said vertical wings having a semi-circular opening adapted to receive a bearing sleeve and an adjacent rectangular opening in said bottom portion of each of said vertical wings.

3. Adjustable fitting as described in claim 2 further comprising two bearing sleeves, each having a circular groove for insertion into said semi-circular opening in each of said vertical wings.

4. Adjustable fitting as described in claim 3 further comprising a spindle attached to the door-side end of the swivel arm for insertion into each of said bearing sleeves, said spindle having a lug-receiving circular groove; a slider having a lug engaging said circular groove of the spindle, said slider being slideably attached to the upper surface of the bearing plate.

* * * * *